US008653732B2

(12) United States Patent
Ramaiah et al.

(10) Patent No.: US 8,653,732 B2
(45) **Date of Patent: *Feb. 18, 2014**

(54) CERAMIC METAL HALIDE LAMP WITH OXYGEN CONTENT SELECTED FOR HIGH LUMEN MAINTENANCE

(75) Inventors: Raghu Ramaiah, Mentor, OH (US); Timothy David Russell, North Ridgeville, OH (US); Ágoston Böröczki, Budapest (HU); Natalie Marie Bate, Mayfield Heights, OH (US)

(73) Assignee: General Electric Company, Schenectady, NY (US)

( * ) Notice: Subject to any disclaimer, the term of this patent is extended or adjusted under 35 U.S.C. 154(b) by 1178 days.

This patent is subject to a terminal disclaimer.

(21) Appl. No.: 12/568,108

(22) Filed: Sep. 28, 2009

(65) Prior Publication Data

US 2010/0013417 A1 Jan. 21, 2010

Related U.S. Application Data

(63) Continuation-in-part of application No. 12/270,216, filed on Nov. 13, 2008, now Pat. No. 8,358,070, which is a continuation-in-part of application No. 11/951,677, filed on Dec. 6, 2007, now Pat. No. 7,868,553.

(51) Int. Cl.
*H01J 61/20* (2006.01)

(52) U.S. Cl.
USPC ..... 313/639; 313/571; 313/640

(58) Field of Classification Search
USPC ..... 313/491, 637–643, 571; 315/358
See application file for complete search history.

(56) References Cited

U.S. PATENT DOCUMENTS

| | | | | |
|---|---|---|---|---|
| 4,005,324 | A * | 1/1977 | Dolenga et al. | 313/579 |
| 4,390,811 | A | 6/1983 | Rothwell | |
| 4,710,674 | A | 12/1987 | Sigai | |
| 4,825,124 | A | 4/1989 | Sigai | |
| 4,943,523 | A | 7/1990 | Stavrianopoulos | |
| 5,013,968 | A | 5/1991 | Russell | |
| 5,111,108 | A | 5/1992 | Goodman | |
| 5,159,229 | A | 10/1992 | Passmore et al. | |
| 5,196,234 | A | 3/1993 | Taubner | |
| 5,691,601 | A | 11/1997 | Frey | |

(Continued)

FOREIGN PATENT DOCUMENTS

| | | |
|---|---|---|
| EP | 0 909 457 B1 | 2/1998 |
| JP | 57 128446 A | 8/1982 |

(Continued)

OTHER PUBLICATIONS

WO Search Report issued in connection with corresponding WO Patent Application No. US10/042679 filed on Jul. 21, 2010.

(Continued)

*Primary Examiner* — Tung X Le
(74) *Attorney, Agent, or Firm* — Fay Sharpe LLP

(57) ABSTRACT

A lamp includes a discharge vessel with electrodes extending into the discharge vessel and an ionizable fill scaled within the vessel. The fill includes a buffer gas, optionally mercury, and a halide component. The lamp includes available oxygen, sealed within the discharge vessel, at a concentration of at least 0.1 μmol O/cc.

45 Claims, 6 Drawing Sheets

(56) References Cited

U.S. PATENT DOCUMENTS

| | | | | |
|---|---|---|---|---|
| 5,708,324 | A | 1/1998 | Anandan | |
| 6,169,361 | B1 | 1/2001 | Boffito et al. | |
| 6,200,918 | B1 | 3/2001 | Yanagitani | |
| 6,210,605 | B1 | 4/2001 | Srivastava | |
| 6,302,959 | B2 | 10/2001 | Srivastava | |
| 6,465,959 | B1 | 10/2002 | Tian | |
| 6,586,878 | B1 | 7/2003 | Tu | |
| 6,713,027 | B2 | 3/2004 | McNulty, Jr. | |
| 6,774,556 | B2 | 8/2004 | Srivastava | |
| 7,002,299 | B2 | 2/2006 | Kawaguchi et al. | |
| 7,057,335 | B2 | 6/2006 | Emilsson | |
| 7,057,350 | B2 | 6/2006 | Lambrechts | |
| 7,268,495 | B2 | 9/2007 | Rintamaki | |
| 7,545,100 | B2 * | 6/2009 | Genz | 313/637 |
| 7,733,027 | B2 * | 6/2010 | Korber et al. | 313/639 |
| 2003/0117073 | A1 * | 6/2003 | Nishida | 313/631 |
| 2004/0189208 | A1 * | 9/2004 | Kurimoto et al. | 313/641 |
| 2005/0082988 | A1 | 4/2005 | Lunter | |
| 2005/0215764 | A1 | 9/2005 | Tuszynski | |
| 2005/0248279 | A1 | 11/2005 | Lambrechts et al. | |
| 2005/0249667 | A1 | 11/2005 | Tuszynski | |
| 2006/0147371 | A1 | 7/2006 | Tuszynski | |
| 2006/0164016 | A1 * | 7/2006 | Rintamaki et al. | 313/638 |
| 2006/0164017 | A1 * | 7/2006 | Rintamaki et al. | 313/640 |
| 2007/0027129 | A1 | 2/2007 | Tuszynski | |
| 2007/0085478 | A1 | 4/2007 | Dakin | |
| 2007/0092549 | A1 | 4/2007 | Tuszynski | |
| 2007/0149496 | A1 | 6/2007 | Tuszynski | |
| 2007/0159104 | A1 | 7/2007 | Kanazawa | |
| 2007/0207186 | A1 | 9/2007 | Scanlon | |
| 2008/0119421 | A1 | 5/2008 | Tuszynski | |
| 2008/0319375 | A1 | 12/2008 | Hardy | |
| 2009/0146570 | A1 | 6/2009 | He et al. | |
| 2009/0146571 | A1 | 6/2009 | Russell | |
| 2009/0146576 | A1 | 6/2009 | Russell et al. | |

FOREIGN PATENT DOCUMENTS

| | | | |
|---|---|---|---|
| JP | 10 312751 | A | 11/1998 |
| WO | WO 99/53523 | A | 10/1999 |
| WO | WO 2009/075943 | A | 6/2009 |

OTHER PUBLICATIONS

U.S. Appl. No. 08/275,614, filed Jul. 13, 1994, O'Donnell.

* cited by examiner

CERAMIC METAL HALIDE LAMP WITH OXYGEN CONTENT SELECTED FOR HIGH LUMEN MAINTENANCE

This application claims the priority, as a continuation-in part of U.S. application Ser. No. 12/270,216, filed Nov. 13, 2008 now U.S. Pat. No. 8,358,070, entitled LANTHANIDE OXIDE AS AN OXYGEN DISPENSER IN A METAL HALIDE LAMP (U.S. Pub. No. 2009/0146570), which application claims priority, as a continuation-in-part of U.S. application Ser. No. 11/951,677, filed Dec. 6, 2007 now U.S. Pat. No. 7,868,553, entitled METAL HALIDE LAMP INCLUDING A SOURCE OF AVAILABLE OXYGEN (U.S. Pub. No. 2009/0146576), the disclosures of which are incorporated herein by reference in their entireties.

BACKGROUND OF THE DISCLOSURE

The present invention relates generally to ceramic arc discharge lamps and more particularly to a discharge lamp in which an oxygen content of the lamp fill during lamp operation is selected to provide a high lumen maintenance.

Discharge lamps produce light by ionizing a vapor fill material, such as a mixture of rare gases, metal halides, and mercury with an electric arc passing between two electrodes. The electrodes and the fill material are sealed within a translucent or transparent discharge vessel that maintains the pressure of the energized fill material and allows the emitted light to pass through it. The fill material, also known as a "dose," emits a desired spectral energy distribution in response to being excited by the electric arc. For example, halides provide spectral energy distributions that offer a broad choice of light properties, e.g., color temperature, color rendering, and luminous efficiency.

Conventionally, the discharge vessel in a discharge lamp was formed from a vitreous material such as fused quartz, which was shaped into desired chamber geometries after being heated to a softened state. These lamps are limited in performance by the maximum wall temperature achievable in the quartz discharge vessel.

Ceramic discharge chambers were developed to operate at higher temperatures for improved color temperatures, color renderings, and luminous efficacies, while significantly reducing reactions with the fill material. One problem with such lamps is that the light output over time (typically expressed as lumen maintenance) tends to diminish due to blackening of the walls of the discharge vessel. The blackening is due to tungsten transported from the electrode to the wall.

It has been proposed to incorporate a calcium oxide or tungsten oxide oxygen dispenser in the discharge vessel, as disclosed, for example in WO 99/53522 and WO 99/53523 to Koninklijke Philips Electronics N.V. Lamps produced according to these applications may not, however, simultaneously meet acceptable lamp efficiency, color point, color stability, lumen maintenance, and reliability values for a commercial lamp.

The exemplary embodiment provides a new and improved metal halide lamp with improved lumen maintenance.

BRIEF DESCRIPTION OF THE DISCLOSURE

In accordance with one aspect of the exemplary embodiment, a lamp includes a discharge vessel. Electrodes extend into the discharge vessel. An ionizable fill is sealed within the vessel, the fill including a buffer gas, optionally mercury, and a halide component. The halide component includes a rare earth halide selected from the group consisting of lanthanum, cerium, neodymium, praseodymium, samarium, and combinations thereof. Available oxygen is sealed within the discharge vessel at a concentration of at least 0.1 μmol O/cc.

In accordance with another aspect of the exemplary embodiment, a lamp includes a discharge vessel. Electrodes extend into the discharge vessel. An ionizable fill is sealed within the vessel, the fill including a buffer gas, optionally mercury, and a halide component, the halide component consisting essentially of halides which, to the extent that they form oxides during lamp operation, the oxides formed are unstable oxides which provide available oxygen. Available oxygen is sealed within the discharge vessel, at a concentration of 0.1-1.5 μmol O/cc.

In accordance with another aspect of the exemplary embodiment, a method of forming lamps with a high lumen maintenance includes providing a set of ceramic metal halide lamps with a halide fill component and a source of available oxygen, whereby at least three or four lamps of the set differ in their respective available oxygen concentrations to provide lamps covering a range of different available oxygen concentrations within a range of from 0.1 μmol O/cc-1.5 μmol O/cc. The lamps are operated by supplying an electric current to each lamp to generate a discharge in the lamp vessel. A lumen maintenance value for each of the lamps is determined. An optimum oxygen concentration or concentration range is computed, based on the determined lumen maintenance values. Lamps are formed with the computed oxygen concentration or with an oxygen concentration within the computed concentration range.

One advantage of at least one embodiment of the present disclosure is the provision of a lamp with improved lumen maintenance.

Still further advantages will become apparent to those of ordinary skill in the art upon reading and understanding the following detailed description of the preferred embodiments.

DETAILED DESCRIPTION OF THE PREFERRED EMBODIMENTS

Aspects of the exemplary embodiment relate to a lamp which includes a discharge vessel with an ionizable fill and a source of oxygen sealed therein. The source of oxygen is present in an amount which provides an oxygen concentration in the fill which is selected to optimize lumen maintenance.

Lumens (lm), as used herein, refer to the SI unit of luminous flux, a measure of the perceived power of light. If a light source emits one candela of luminous intensity into a solid angle of one steradian, the total luminous flux emitted into that solid angle is one lumen. Put another way, an isotropic one-candela light source emits a total luminous flux of exactly 4π lumens. The lumen can be considered as a measure of the total "amount" of visible light emitted. The output of a lamp can be defined in terms of Lumens per Watt (LPW). Lumen maintenance is the ratio of lumens after a given period of lamp operation (e.g., 1000 hrs) to the initial lumens (e.g., after 100 hrs of operation). The exemplary lamp may have a lumen maintenance of at least 95% or at least 98%, or greater at 1000 hrs or at 2000 hrs. This may be achieved with a wall temperature of the discharge vessel of no greater than 1460K.

In various aspects, the lamp is able to simultaneously satisfy photometric targets without compromising targeted lumen maintenance. Some of the photometric properties that are desirable in a lamp design include CRI, CCT, lamp output (e.g., expressed as Lumens/Watt), and dCCy.

The color rendering index CRT is a measure of the ability of the human eye to distinguish colors by the light of the lamp. The color rendering index Ra, as used herein, is the standard measure used by the Commission Internationale de l'Eclairage (CIE) and refers to the average of the indices for eight standardized colors chosen to be of intermediate saturation and spread throughout a range of hues measured (sometimes referred to as R8). Values are expressed on a scale of 0-100, where 100 represents the value for a black body radiator. The exemplary lamp may have a color rendering index, Ra of at least about 85, and can be up to about 87, or higher.

The correlated color temperature CCT, as used herein, is the color temperature of a black body radiator which in the perception of the human eye most closely matches the light from the lamp. The exemplary lamp may provide a correlated color temperature (CCT) between about 2700K and about 4500K, e.g., 3000K.

dCCy is the difference in chromaticity of the color point on the Y axis (CCY), from that of the standard black body curve. The exemplary embodiment may have a dCCy of −0.005+/−0.010 with respect to the black body locus, and in one specific embodiment, the lamp lies directly on the black body locus, i.e., dCCy=0.000.

All of these ranges may be simultaneously satisfied in the present lamp design. This can be achieved without negatively impacting lamp lumen maintenance.

Figure 1:
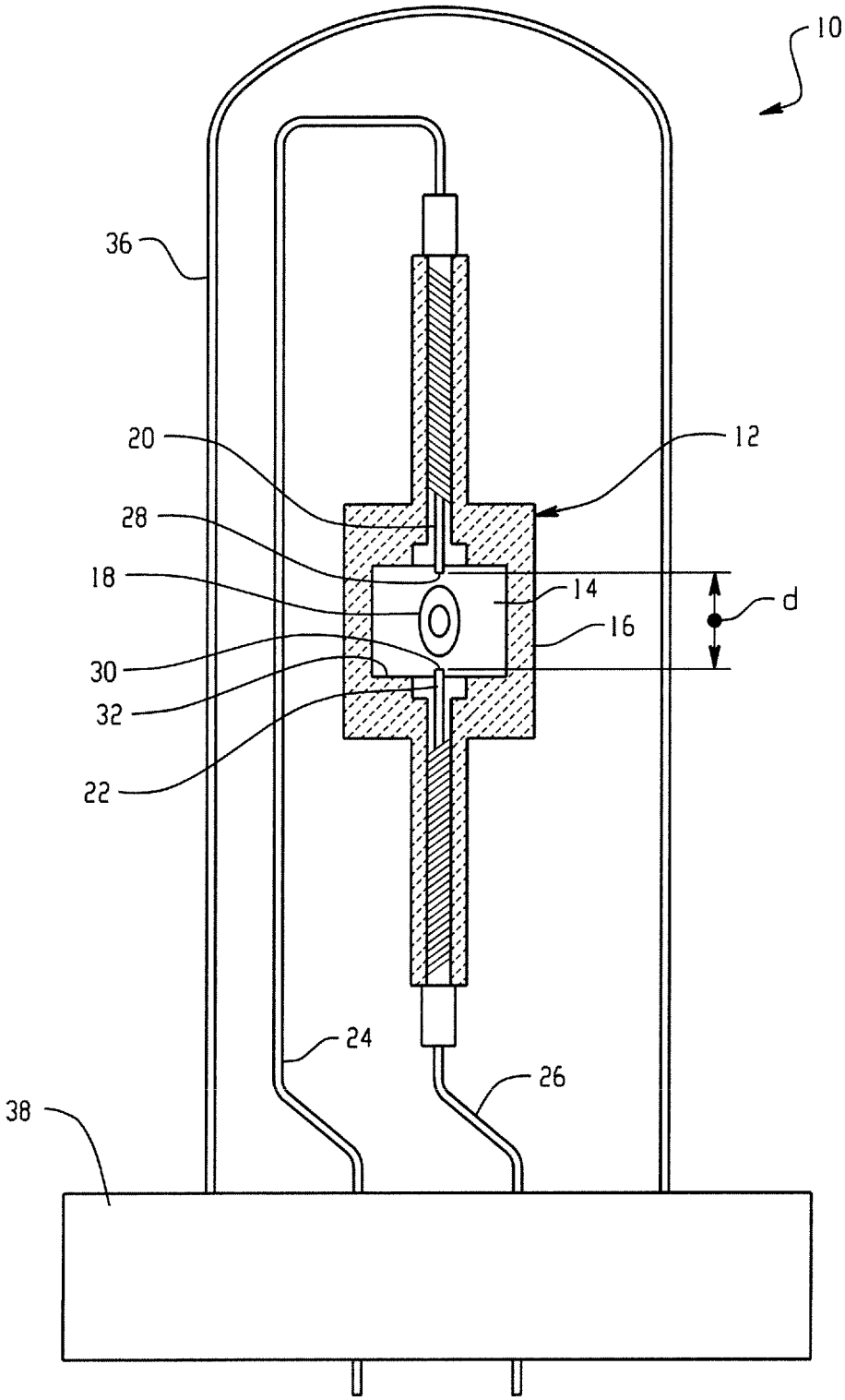
FIG. 1 is a cross sectional view of a lamp in accordance with the exemplary embodiment.
Figure 2:
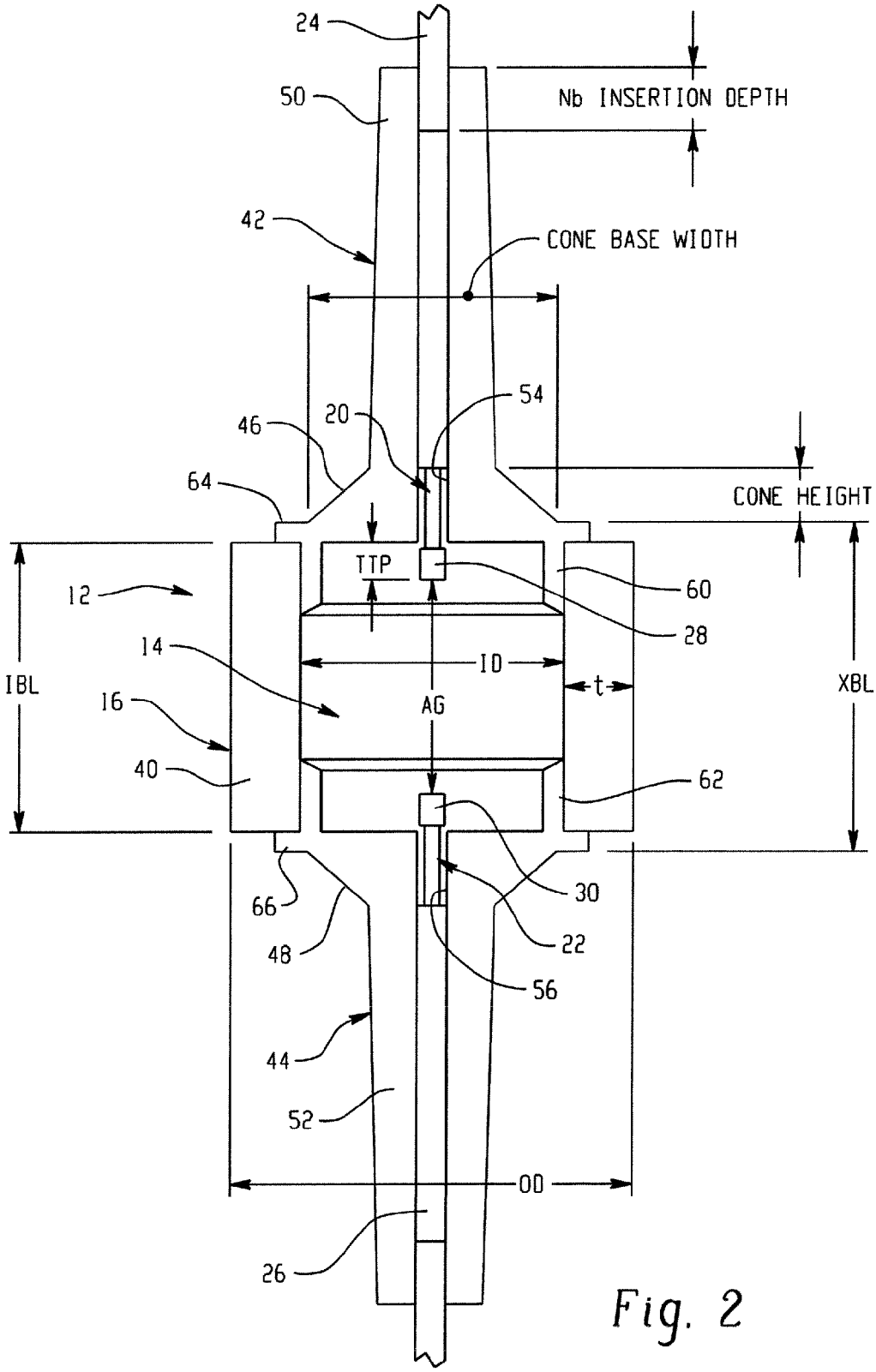
FIG. 2 is an enlarged cross sectional view of the discharge vessel of FIG. 1 in accordance with one aspect of the exemplary embodiment.

With reference to FIG. 1, a lamp 10 comprising a ceramic metal halide (CMH) discharge vessel 12 in accordance with the exemplary embodiment is shown. FIG. 1 is intended to be exemplary only. With reference also to FIG. 2, one embodiment of the discharge vessel 12 is shown for illustration. The exemplary discharge vessel 12 is suited to use in lamps operating at a variety of wattages, such as about 15-200 watts. By way of example, lamps of 39 and 70 watts are described herein without intending to limit the scope of the invention. The wattage of a lamp is typically based on an assumed AC lamp voltage of 95V. The lamp 10 is supplied with current by a circuit (not shown) connected with a source of AC power. The lamp may be designed to run on an electronic ballast, at higher frequency. Alternatively, the lamp may be run on a DC power source.

The discharge vessel 12 defines an interior discharge space or chamber 14. The discharge vessel 12 includes a high pressure envelope or arc tube 16, formed from a transparent or translucent material, such as polycrystalline alumina or sapphire (single crystal alumina), which is sealed at opposite ends to enclose the discharge space 14. The discharge space 14 contains a fill of an ionizable gas mixture 18, such as metal halide and inert gas mixture, which may also include mercury.

First and second internal electrodes 20, 22, which may be formed entirely or at least partly (>20 wt. %) from tungsten, extend into the discharge space 14. A discharge forms in the fill 18 between the electrodes 20, 22 when a voltage is applied across the electrodes. The electrodes are connected to conductors 24, 26, formed from molybdenum and niobium sections. The conductors 24, 26 electrically connect the electrodes to the external power supply. Tips 28, 30 of the electrodes extend interiorly of a respective interior end wall 32, 34 of the arc tube 16 and are spaced by an arc gap AG of dimension d.

The discharge vessel 12 may be enclosed in an outer envelope 36 of glass or other suitable transparent or translucent material, which is closed by a lamp cap 38 at one end, although double-ended lamps are also contemplated. In other embodiments, the lamp may be housed in a reflective housing.

As shown in FIG. 2, the exemplary ceramic arc tube 16 includes a hollow cylindrical portion or barrel 40 and two opposed hollow end plugs 42, 44. The barrel 40 and end plugs 42, 44 may be formed from separate components that are fused together during formation of the lamp. The two end plugs 42, 44 may be similarly shaped and each includes a cone or base portion 46, 48, from which respective hollow leg portions or tubes 50, 52 extend outwardly. The electrodes 20, 22 are seated in bores 54, 56 within their respective leg portions 50, 52 and extend into respective cylindrical hollow portions 60, 62, of the cylindrical base portions. The cylindrical hollow portions 60, 62 are received in the respective ends of the barrel 40 to create an annular thickened region when the two parts are joined together (FIG. 2). An annular rim portion or flange 64, 66 extends radially outward of the respective hollow portion 60, 62 and is sealed to a respective end of the barrel to define the end walls 32, 34 of the discharge space 14.

The discharge chamber 14 is sealed at the ends of the leg portions 50, 52 by seals (not shown) to create a gas-tight discharge space.

Various dimensions of the arc tube 16 will now be defined:

Interior barrel length, IBL=distance between end walls 32, 34, measured along the lamp axis (mm).

Exterior barrel length, XBL=length of barrel plus flanges (mm).

Interior Diameter, ID=average interior diameter of the barrel in the middle region, intermediate the electrode tips, i.e., away from the cylindrical portions 60, 62 of the end plugs (in mm).

Wall thickness, t−=thickness (mm) of the wall material in the central portion of the arc tube body, e.g., half way between the electrode tips.

Outside diameter, OD=maximum diameter of the barrel.

Tip to plug distance TTP=distance between the tip 28, 30 of the electrode and the adjacent end wall 32, 34 (mm). Note IBL=d+2 TTP Arc gap, AG=distance between electrode tips 28, 30 at their closest point (mm).

Internal area, IA=chamber internal surface area in $cm^2$.

WL=wall loading, in $W/cm^2$ of interior wall surface including the end bowls, but excluding legs, and the arctube power (W) is the total arctube power including electrode power. In one embodiment, the wall loading is from about 11 to 52 $W/cm^2$, for example, about 14 to 32 $W/cm^2$. In one embodiment, a wall temperature of the discharge vessel, during operation, is no greater than 1460 K.

Figure 3:
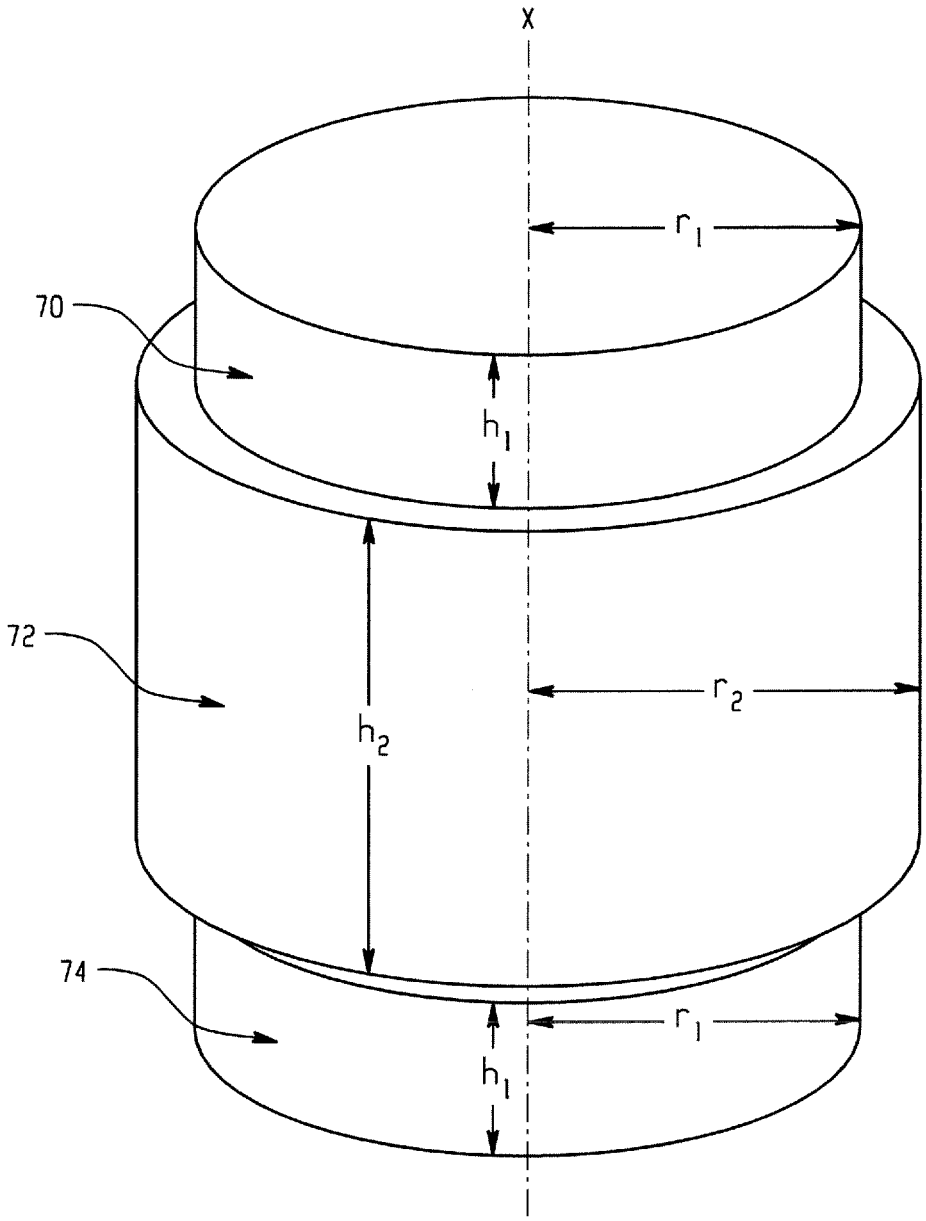
FIG. 3 is an enlarged perspective view of the interior volume of the discharge vessel of FIGS. 1 and 2.

Chamber Volume, Vol. (cc)—interior volume of the chamber, not including the bores. For a cylindrical lamp as shown, which is essentially composed of three cylindrical interior volume portions 70, 72, 74, as shown in FIG. 3, where the first and third portions 70, 74 are of height $h_1$ and interior radius $r_1$, and the intermediate portion 72 is of height $h_2$ and interior radius $r_2$, then the total volume of this design is $2\pi r_1^2 h_1 + \pi r_2^2 h_2$. Where the lamp barrel is curved (see, e.g., FIG. 4), rather than substantially cylindrical, as shown in FIGS. 2 and 3, the curvature may be taken into account when computing the volume, e.g., using the SOLIDWORKS™ program. This methodology can be applied to any shape of lamp. In the examples which follow, the chamber volume is determined through calculation based on lamp dimensions, although it is also contemplated that for less regularly shaped chambers, the chamber volume may be determined by other means, such as by determining the added weight of the arc tube when filled with water, converting this to an equivalent volume, and subtracting a volume of the water occupying the legs.

By way of example, parameters for 39 W and 70 W lamps may be as shown in TABLE 1:

TABLE 1

| | 39 W | | 70 W | |
|---|---|---|---|---|
| PARAMETER | Example range | Example | Example range | Example |
| IBL | 6-8.5 mm | 7.6 mm | 7.5-9 mm | 8.6 mm |
| Plug Thickness | 0.15-1 mm | 0.6 mm | 0.6-0.8 mm | 0.6 mm |
| ID | 5-7 mm | 5.7 mm | 5.5-6.8 mm | 6.6 mm |
| T | 0.6-1.2 mm | 0.6 mm | 1.3-1.7 mm | 1.6 mm |
| OD | 6.2-9.4 mm | 6.9 | 8-10.5 | 9.6 mm |
| TTP | 0.7-2 mm | 1.5 | 0.7-2.0 mm | 1.3 mm |
| AG | 3-7 mm | 4.7 | 5.5-6 | 6 mm |
| AG/ID | 0.4-1.4 | 0.82 | 0.8-1.1 | 0.9 |
| I A | 1.3-2.6 cm2 | 1.73 cm2 | 1.7-2.7 cm2 | 2.29 $cm^2$ |
| W L | 14-30 w/cm2 | 22.6 w/cm2 | 26-40 $w/cm^2$ | 30.6 $w/cm^2$ |
| Halide dose weight | 4-14 mg (12-120 mg/cc) | 8.3 mg (47 mg/cc) | 4-14 mg (12-80 mg/cc) | 12 mg (46.2 mg/cc) |
| Wt. tungsten, expressed as $WO_3$ (mg) | 0.003-0.02 | 0.0043 | 0.009-0.02 | 0.0092 |
| Wt oxygen (mg) | 0.0007-0.005 | 0.0009 | 0.002-0.005 | 0.0019 |
| Vol | 0.12-0.3 $cm^3$ | 0.18 $cm^3$ | 0.2-0.4 $cm^3$ | 0.26 $cm^3$ |

The exemplary fill 18 includes a metal halide component or "dose" which includes a halide component comprising one or more metal halides, optionally mercury, and a rare gas, such as argon or xenon. The halide component may include halides selected from the following: Group I) metal halides, such as sodium halide; Group II) metal halides, such as calcium halides; Group III) A halides, such as thallium halides and indium halides, hafnium halides, zirconium halides, rare earth halides, such as halides of Sc, Y, and the lanthanoids, i.e., La, Ce, Pr, Pm, Sm, Eu, Gd, Tb, Dy, Ho, Er, Tm, Yb, Lu, and combinations thereof. The halides may be chlorides, bromides, iodides or combinations thereof.

In one embodiment, the halide component includes at least one rare earth halide. The rare earth halide(s) may be selected in type and concentration such that in combination with the source of oxygen or oxygen derived therefrom, it forms an unstable oxide in the fill during lamp operation. By "unstable oxide" it is meant that the oxide comprising the rare earth element allows available oxygen to exist in the fill during lamp operation. Suitable rare earth halides may be selected from the group consisting of lanthanum halides, praseodymium halides, neodymium halides, samarium halides, cerium halides, and combinations thereof. In one specific embodiment, the fill is free of all other rare earth halides than these. Specifically, the fill may be free of halides of terbium, dysprosium, holmium, thulium, erbium, ytterbium, yttrium, and lutetium. The fill may also be free of other halides which do not form stable oxides, such as scandium and magnesium halides. By free, it is meant that all halides of rare earths other than lanthanum, praseodymium, neodymium, samarium, cerium, (and optionally also scandium and magnesium), account for a total mole fraction of less than 0.001 of the halide component of the fill, and in one embodiment, a mole fraction of less than 0.0001. In this way the halide component consists essentially of halides which, to the extent that they form oxides during lamp operation, the oxides formed are unstable oxides which provide available oxygen.

In one specific embodiment, the rare earth halide includes lanthanum halide.

The rare earth halide(s) may be present in an amount such that, during lamp operation, in combination with the source of available oxygen, maintains a difference in solubility for tungsten species present in a vapor phase between a wall of the discharge vessel and at least a portion of at least one of the electrodes.

The rare earth halide(s) may be present in the fill, expressed as a total mole fraction of the halide component of the fill, of at least about 0.009, and in one embodiment, can be up to about 0.2.

For example, iodides of sodium, thallium, calcium, and lanthanum are the predominant halides included in the fill, with other halides making up no more than a total of 20 mol %, e.g., less than 10 mol %, of the halides in the fill, and in one embodiment, less than 1 mol %.

By way of example, the halides may be present in the fill in the following mole fractions, based on the total halides in the fill:

Na at least 0.3, e.g., up to 0.8;

TlI at least 0.01, e.g., at least 0.02, and can be up to 0.06 or up to 0.035;

$LaI_3$ at least 0.009, such as at least 0.02 or at least 0.07 and can be up to 0.3, e.g., up to 0.13; and $CaI_2$ at least 0.09, e.g. up to 0.4, such as up to 0.33.

In one embodiment, the fill is free of all rare earth halides other than halides of lanthanum. By free of rare earth halides other than lanthanum, it is meant that other rare earth halides are present at no more that 10% of the lanthanum halide mol %.

The halide weight (HW), which is the weight (mg) of all the halides in the arc tube 16, can be from about 8.0 to 280 mg/cc, e.g., 43 to 63 mg/cc.

The discharge vessel 12 encloses a source of available oxygen. The oxygen provided by the source aids in the wall cleaning cycle and thus can improve lumen maintenance over the lifetime of the lamp.

As used herein, the "available oxygen" is determined as the moles of oxygen (determined as singlet O rather than $O_2$) per unit volume of arc tube, e.g., in micromoles O per cubic centimeter of lamp volume, determined as described above, abbreviated as μmol O/cc. To be available means, the oxygen is in a form in which it is capable of taking part in the wall cleaning cycle at the operating temperature of the lamp. Specifically, it is in a form which is capable of taking place in the wall cleaning cycle. The available oxygen makes oxygen available for reaction with other fill components to form $WO_2X_2$, where X is a halide, e.g., $WO_2I_2$, or other tungsten oxyhalide species, at the operating temperature of the lamp. Thus, for example, while alumina-based ceramics include oxygen, the oxygen present is too tightly bound to take part in the wall cleaning cycle, and thus, this is not considered available oxygen.

The available oxygen may be present in the lamp at a concentration of at least 0.1 μmol O/cc, e.g., at least 0.14 μmol O/cc, and in one embodiment, at least 0.2 μmol O/cc or at least 0.3 μmol O/cc of lamp volume (where lamp volume is determined as described above). In one specific embodiment, the oxygen is present at a concentration of at least 0.4 μmol O/cc. The available oxygen may be present at up to 1.5 μmol O/cc, e.g., up to 1.1 μmol O/cc, and in specific embodiments, up to 1.0 or 0.9 or 0.8 μmol O/cc. In one specific embodiment, the oxygen is present at a concentration of 0.4 to 0.7 μmol O/cc.

Since available oxygen can diminish over time during lamp operation, the available oxygen is considered to be the maximum available oxygen in the discharge chamber during lamp operation. In one embodiment, the available oxygen is selected to be closer to the upper end of the range to allow for loss of oxygen over time.

Exemplary sources of oxygen are described in U.S. application Ser. Nos. 11/951,677, 11/951,724, and 12/270,216, and include oxides of tungsten. By oxide of tungsten, it is meant any oxidized form of tungsten or combination thereof which includes at least one tungsten oxygen bond. Examples of oxides of tungsten include oxides and oxyhalides of tungsten and reactants/compounds which react or decompose in the lamp under lamp operating conditions to form tungsten oxide or oxyhalide. In one embodiment, the oxide of tungsten may have the general formula $WO_nX_m$, where n is at least 1, m can be ≥0, and X is a halide as defined above. Exemplary oxides of tungsten include $WO_3$, $WO_2$, and tungsten oxyhalides, such as $WO_2I_2$, and combinations thereof. Other sources of available oxygen include free oxygen gas ($O_2$), water, molybdenum oxide, mercury oxide, dioxides of lanthanum, cerium, neodymium, samarium, praseodymium, or combinations thereof.

The source of available oxygen is present in sufficient amounts to provide available oxygen in the lamp in the amounts described above.

Various methods exist for determining the available oxygen, including inert gas fusion, energy dispersive X-ray analysis (EDAX), and Electron Spectroscopy for Chemical Analysis (ESCA, also known as XPS). For example, oxygen can be measured at concentrations as low as 1 ppm by an inert gas fusion technique, such as with a LECO oxygen analyzer, available from LECO Corp.

In one embodiment, the oxygen content is determined by analysis of the dose mixture prior to introduction to the lamp (which includes the metal halides and solid oxygen source), e.g., with LECO. This is the method used to determine the oxygen added to the lamp, and thus is molar concentration per unit volume, in the example lamps described below. This method assumes that the dose mixture is the only source of oxygen. This assumption is accurate provided that oxygen is not added to the discharge vessel in significant amounts from other sources, e.g., through oxidation of the tungsten electrodes or introduction of oxygen gas. The assumption can be validated by measuring the oxygen content of the dose pool after several hours of lamp operation. It has been found that other sources of oxygen, such as the freshly prepared electrodes, account for a relatively minor portion of the available oxygen content (<about 1% of the total available oxygen) and thus, in the exemplary embodiment, are ignored. If oxidized electrodes are used, the contribution of the oxygen in the electrodes should be taken into account in determining the available oxygen.

Another way to determine the oxygen content is to prepare a lamp then analyze the dose pool, e.g., by breaking open a lamp and analyzing the lamp contents. This should be done before extended lamp operation takes place, since during lamp operation, oxygen tends to be consumed. Additionally, the lamp should be opened in an oxygen free atmosphere so that atmospheric oxygen does not influence the results. In this method, EDAX or ESCA may be used to determine the oxygen content. In tests on lamps, the LECO method and EDAX method give reasonable agreement, provided that care is taken in the EDAX method to exclude external sources of oxygen.

Unexpectedly, it has been found that within a narrow range, the available oxygen content has a marked effect on lumen maintenance and further, that even though it is used in the wall cleaning cycle, only a very small amount of oxygen is needed. Lumen maintenance of at least 98% or 99% or higher at 1000 hrs can be readily achieved by careful control of the available oxygen using a fill which includes iodides of Na, Tl, La, and Ca.

It has also been found that the parameter mol O/cc which provides an optimum lumen maintenance is largely independent of the lamp internal volume. Thus, 39 W lamps, which are generally smaller in volume than 70 W lamps, have approximately the same optimum mol. O/cc for a lamp fill which is otherwise nominally identical, e.g., in terms of mol/cc of the halides. It has also been found that the parameter molar ratio $$\frac{[\text{total halide}]}{[\text{O}]} \Big/ \text{cc}$$

may also play a role in lamp lumen maintenance.

Figure 5:
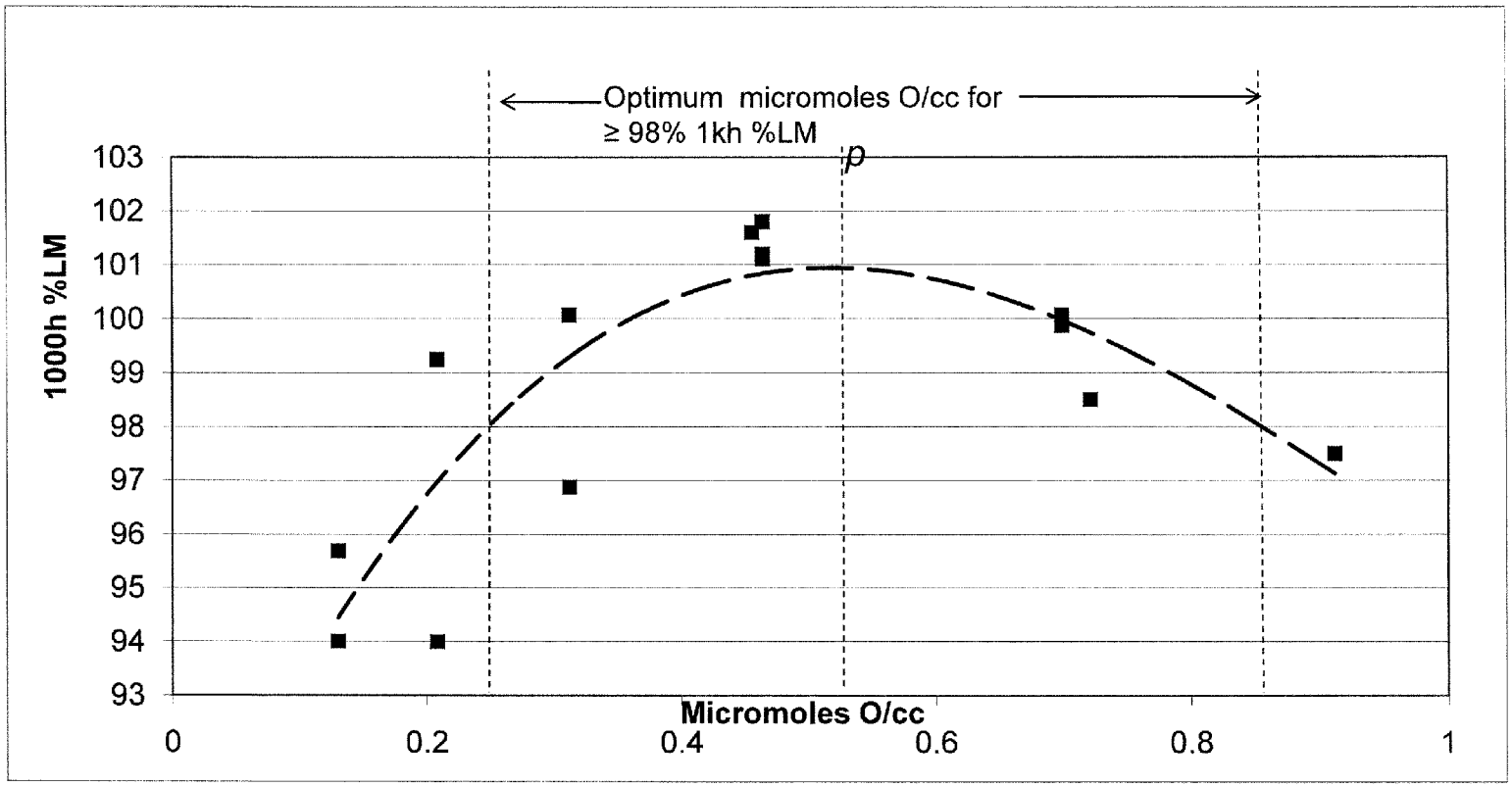
FIG. 5 is a combined plot of 1000 hr % lumen maintenance vs. oxygen concentration for 39 W and 70 W lamps with different oxygen concentrations.

In one embodiment, the optimum oxygen content for lumen maintenance is determined by preparing lamps with different available oxygen concentrations and measuring the lumen maintenance. For example, four or more lamps with different oxygen concentrations are selected which may span an oxygen concentration range of, for example, about 0.1 to about 1.5 micromoles O/cc, or a narrower range within that broader range. The lamps are burned in their normal operating position (e.g., vertically or horizontally). A plot of oxygen concentration vs. lumen maintenance reveals that the lumen maintenance reaches a maximum, with increasing oxygen, then declines as oxygen concentration continues to increase, as illustrated in FIG. 5, where each point represents an average of several lamps. By selecting an oxygen content in the peak region, e.g., no more than, for example ±0.3 μmol O/cc from the concentration at the peak p, and in one embodiment, no more than ±0.25 μmol O/cc from the concentration at the peak p, (equal to 0.54 μmol O/cc in FIG. 5), an optimal lumen maintenance can be achieved. In one embodiment, an available oxygen concentration is selected which provides at least a 98% lumen maintenance at 1000 hrs. For example, as shown in FIG. 5, the experimental data indicates the peak occurs at 0.54 μmol O/cc. Hence 98% lumen maintenance at 1000 hours can be achieved with a range of 0.25 to 0.865 μmol O/cc. The higher the desired % lumen maintenance at 1000 hours, the narrower the selected range of μmol O/cc may be.

In another example, if the peak is at 0.45 μmoles/cc, the selected [O] concentration may range from 0.2 to 0.7 μmoles O/cc, e.g., from 0.35 μmoles O/cc to 0.55 μmoles/cc.

In one embodiment, the location of the peak may be determined by finding the intersection between a first line, determined by linear regression through the points on one side of the peak, and a second line, determined by linear regression through the points on the other side of the peak. Alternatively, the peak may be found by curve fitting methods, e.g., by best fitting a curve to a polynomial expression, such as the expression $y=Ax^3+Bx^2+Cx+D$, where y is in units of 1 khr % LM, and x is in units of μmol O/cc, and A, B, C, and D are constants. The strength of the fit is determined by the parameter $R^2$.

For example, the oxygen concentration can be selected to provide lumen maintenance of at least 98% or at least 100% of that at 100 hrs after 1000 hrs.

In one embodiment, the oxygen source is present in sufficient quantity to provide available oxygen in the arc tube during initial lamp operation of from 0.14 to 1.0 micromoles/cc of arc tube volume (with volume measured as described above), the oxygen content being determined from the ppm oxygen concentration output by a LECO analyzer on the dose material.

Results for lumen maintenance beyond 1000 hrs may drop as oxygen is consumed. For example, for a 70 W lamp with O μmoles/cc formed as above, the following results may be obtained.

| | |
|---|---|
| 1kh % LM | 101.1 |
| 2kh % LM | 98.2 |
| 3kh % LM | 94.9 |

It is to be noted that halide dose concentration also has some effect on the lumen maintenance, and may also be adjusted to provide an optimum lumen maintenance. In one embodiment, a molar ratio of $$\frac{[\text{total halide}]}{[\text{O}]}\Big/\text{cc}$$

of arc tube volume in the fill may be from 900 to 6000, and in one embodiment, is from about 1000 to 5700. As for the O concentration, the value of this parameter may be selected to provide ≥98 1000 hr % LM, e.g., ≥98 1000 hr % LM. Thus for example, for a lamp to achieve 98% lumen maintenance at 1000 hours, the range of molar ratio $$\frac{[\text{total halide}]}{[\text{O}]}\Big/\text{cc}$$

may be a range of 1000 to 5700, and for 99% 1000 hr % LM, from about 1250 to 5150.

The halide concentration in the fill may be determined, for example, by chemical means such as inductively coupled plasma mass spectrometry (ICP-MS) analysis.

The exemplary cylindrical barrel portion 40 and end plugs 42, 44 may all be formed from a polycrystalline aluminum oxide ceramic, although other polycrystalline ceramic materials capable of withstanding high wall temperatures up to 1700 to 1900° K, and which are resistant to attack by the fill materials, are also contemplated. The ceramic arc tube may be formed from a single component or from multiple components, as disclosed, for example, in above-mentioned U.S. application Ser. Nos. 11/951,677 and 12/270,216. For example, three main components which constitute the barrel and end plugs of the finished arc tube are separately fabricated, for example, by die pressing, injection molding, or extruding a mixture of a ceramic powder and a binder system into a solid body. After assembly of the fired parts, the assembly is sintered at a high temperature (e.g., at 1850 to 1880° C. in a hydrogen atmosphere) to form a gas tight, transparent or translucent arc tube of densely sintered polycrystalline alumina.

Without intending to limit the exemplary embodiment, the following Examples demonstrate the performance of the exemplary lamp.

EXAMPLES

Figure 4:
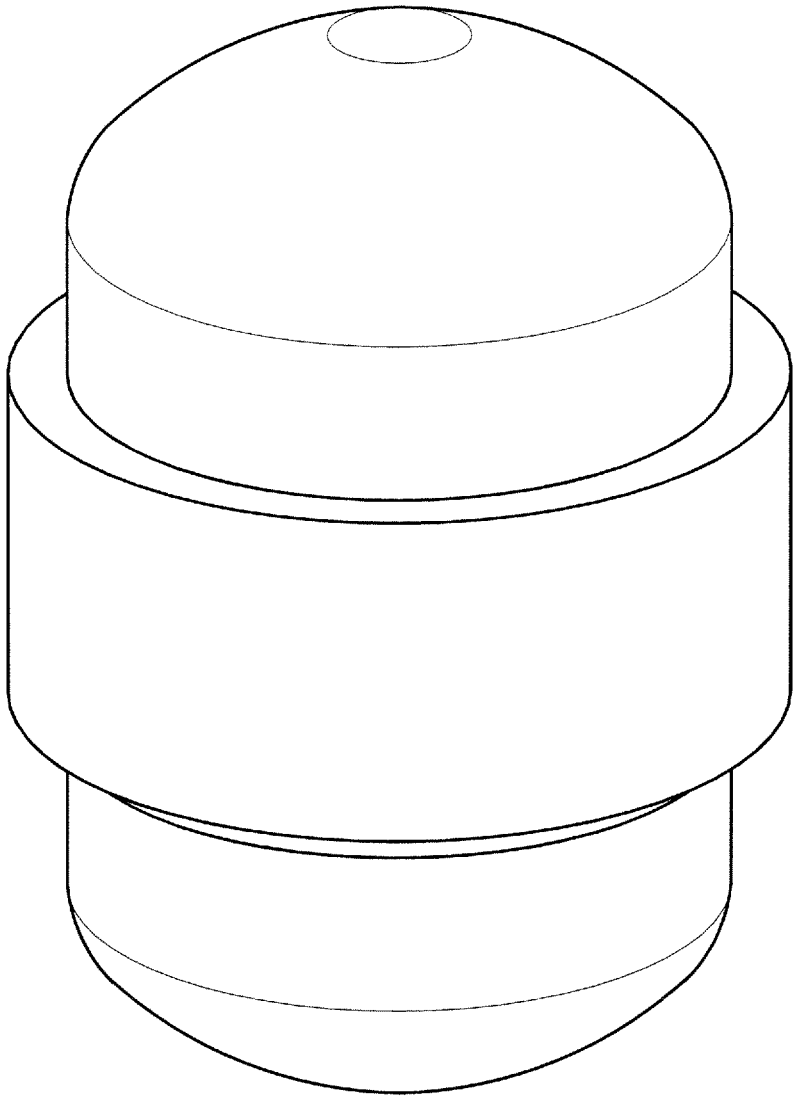
FIG. 4 is an enlarged perspective view of the interior volume of an alternative discharge vessel with rounded ends.

70 W ceramic arc tubes having dimensions, as shown in TABLE 1, and a substantially cylindrical shape, as shown in FIG. 3, were formed. 39 W ceramic arc tubes having dimensions similar to those shown in TABLE 1, and a substantially cylindrical shape or rounded end, as shown in FIGS. 3 and 4, were formed. A dose material which included an oxide of tungsten and halides of Na, Tl, La, Ca was introduced and sealed within the lamps. The oxygen content of the dose was determined by LECO on a bulk sample and converted to moles O/cc for the arc tubes, based on the number of pellets added and assuming a nominally identical volume of the arc tubes. The oxygen content of batches of pellets was varied to provide nominally identical fills other than with respect to available oxygen.

For 70 W lamps, the total halide weight was approximately 12.5 mg and for 39 W lamps the total halide weight was approximately 8.3 mg (see Table 2 for actual amounts in micromoles). Argon gas was present at a fill pressure of 120 Torr. Mercury weight for both 39 W and 70 W was about 5 mg.

For the 70 W lamps, dose weights and dose mole fractions were approximately as follows, with exact amounts given in TABLE 2:

NaI 6.4 mg (70.8 mol % of halide component)

TlI 0.8 mg (4.3 mol % of halide component)

$LaI_3$ 2.1 mg (18.2 mol % of halide component)

$CaI_2$ 3.2 mg (6.7 mol % of halide component)

TABLE 2 summarizes the properties of the lamps tested for 70 W and 39 W lamps.

TABLE 2

| Cell | Lamp Wattage | $LaI_3$ mol % | NaI mol % | TlI mol % | $CaI_2$ mol % | Total Halide in lamp (micromol.) | No of lamps | Burn Orientation | Vol ($cm^3$) |
|---|---|---|---|---|---|---|---|---|---|
| 1 | 39 w | 6.7 | 71 | 4.3 | 18.1 | 38.3 | 4 | VBU | 0.18 |
| 2 | 39 w | 7 | 71 | 4 | 18 | 43.5 | 15 | HOR | 0.11 |
| 3 | 39 w | 6 | 74 | 4 | 16 | 38.2 | 13 | HOR | 0.11 |
| 4 | 39 w | 7.8 | 66.1 | 5 | 21.1 | 45.3 | 7 | VBU | 0.18 |
| 5 | 39 w | 9 | 60.7 | 5.8 | 24.5 | 33.6 | 6 | VBU | 0.18 |
| 6 | 39 w | 8.7 | 62.2 | 5.5 | 23.5 | 43.9 | 9 | VBU | 0.18 |
| 7 | 39 w | 9 | 60.7 | 5.8 | 24.5 | 33.9 | 9 | VBD | 0.18 |
| 8 | 39 w | 8.3 | 64 | 5.3 | 22.4 | 37.1 | 9 | VBD | 0.18 |
| 9 | 70 w | 6.6 | 71.1 | 4.2 | 18 | 59.9 | 22 | VBU | 0.26 |
| 10 | 70 w | 6.6 | 71.1 | 4.2 | 18 | 59.8 | 27 | VBU | 0.26 |
| 11 | 70 w | 6.6 | 71.1 | 4.2 | 18 | 59.8 | 29 | VBU | 0.26 |
| 12 | 70 w | 6.6 | 71.1 | 4.2 | 18 | 59.8 | 20 | VBU | 0.26 |
| 13 | 70 w | 6.6 | 71.1 | 4.2 | 18 | 59.8 | 15 | VBU | 0.26 |
| 14 | 70 w | 6.6 | 71.1 | 4.2 | 18 | 59.8 | 12 | VBU | 0.26 |

For the 39 W lamps, several different lamp structures were used, including rounded end lamps, as illustrated in FIG. 4, reflected in the different lamp volumes. VBU indicates the lamp was burned vertically, base up. VBD indicates the lamp was burned vertically, base down. HOR indicates that the lamp was burned horizontally.

TABLE 3 shows the results obtained when the lamps were burned for at least 1000 hours. The results are the average of several lamps (generally at least 4 or 5) in each case for lamps burned vertically with an outer jacket.

TABLE 3

| Cell | Lamp Wattage | Micromol. Total Halide | Micromol. Total O | molar ratio [Halide/O]/cc | Average 1000 hrs % Lumen maintenance |
|---|---|---|---|---|---|
| 1 | 39 w | 38.3 | 0.055 | 3923.7 | 100.7 |
| 2 | 39 w | 43.5 | 0.074 | 5613.7 | 101.0 |
| 3 | 39 w | 38.2 | 0.074 | 4935.4 | 99.9 |
| 4 | 39 w | 45.3 | 0.055 | 4638.6 | 96.9 |
| 5 | 39 w | 33.6 | 0.023 | 8255.3 | 94.0 |
| 6 | 39 w | 43.9 | 0.037 | 6741.4 | 94.0 |
| 7 | 39 w | 33.9 | 0.023 | 8336.1 | 94.5 |
| 8 | 39 w | 37.1 | 0.037 | 5694.2 | 99.2 |
| 9 | 70 w | 59.9 | 0.237 | 974.6 | 97.5 |
| 10 | 70 w | 59.8 | 0.121 | 1910.8 | 101.1 |
| 11 | 70 w | 59.8 | 0.121 | 1910.8 | 101.2 |
| 12 | 70 w | 59.8 | 0.121 | 1910.8 | 101.8 |
| 13 | 70 w | 59.8 | 0.118 | 1945.5 | 101.6 |
| 14 | 70 w | 59.8 | 0.187 | 1229.9 | 98.5 |

FIG. 5 shows a plot of 1000 hrs % lumen maintenance vs. moles [O]/cc, derived from these results. As discussed above, 98% 1000 hr lumen maintenance can readily be achieved in similar lamps with similar halide concentrations by selecting a molar oxygen concentration within the range prescribed by the dotted lines.

Figure 6:
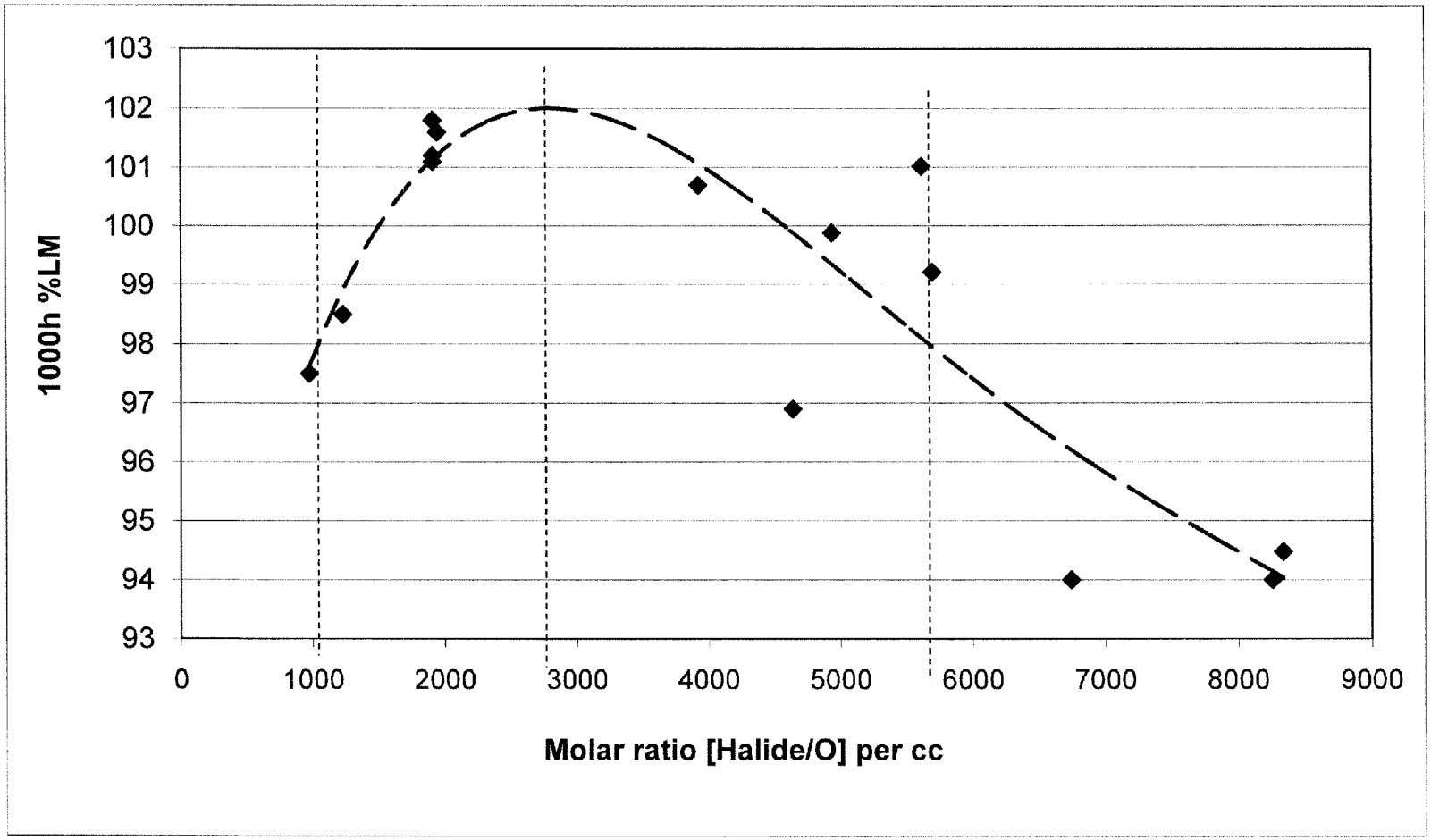
FIG. 6 is a combined plot of 1000 hr % lumen maintenance vs. molar ratio [halide/O] per cc for 39 W and 70 W lamps.

FIG. 6 shows a plot of 1000 hour % lumen maintenance versus the parameter: molar ratio $$\frac{[\text{total halide}]}{[O]} \Big/ \text{cc}.$$

As shown in FIG. 6, the experimental data, as constructed from TABLES 2 and 3, indicates the peak in 1000 hour % lumen maintenance at a molar ratio $$\frac{[\text{total halide}]}{[O]} \Big/ \text{cc}$$

of around 2700. Hence it can be expected that 98% lumen maintenance at 1000 hours can be achieved with a molar ratio $$\frac{[\text{total halide}]}{[O]} \Big/ \text{cc}$$

in a range of 1000 to 5700 (which can be determined, for example, by applying an algorithm for fitting a curve to the points of the graph). 99% lumen maintenance at 1000 hours can be achieved with a molar ratio $$\frac{[\text{total halide}]}{[O]} \Big/ \text{cc}$$

in a range of about 1250 to 5150.

The higher the desired % lumen maintenance at 1000 hours, the narrower the required range of molar ratio $$\frac{[\text{total halide}]}{[O]} \Big/ \text{cc}$$

becomes.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A lamp comprising:

a discharge vessel;

electrodes extending into the discharge vessel;

an ionizable fill sealed within the vessel, the fill comprising:

a buffer gas, and a halide component, the halide component including a rare earth halide selected from the group consisting of lanthanum halides, cerium halides, neodymium halides, praseodymium halides, samarium halides, and combinations thereof;

available oxygen, sealed within the vessel at a concentration of at least 0.1 micromoles of oxygen, expressed as singlet oxygen, per cubic centimeter of lamp volume (μmol O/cc).

2. The lamp of claim 1, wherein the available oxygen is at a concentration of at least 0.14 μmol O/cc.

3. The lamp of claim 2, wherein the available oxygen is at a concentration of at least 0.3 μmol O/cc.

4. The lamp of claim 1, wherein the available oxygen is at a concentration of up to 1.5 μmol O/cc.

5. The lamp of claim 4, wherein the available oxygen is at a concentration of up to 1.0 μmol O/cc.

6. The lamp of claim 1, wherein the available oxygen is at a concentration that provides a lumen maintenance at 1000 hrs, expressed as a percentage of lumens at 100 hrs, of at least 98%.

7. The lamp of claim 6, wherein the available oxygen is at a concentration that provides a lumen maintenance at 1000 hrs, expressed as a percentage of lumens at 100 hrs, of at least 99%.

8. The lamp of claim 1, wherein the halide component includes at least one source of iodine.

9. The lamp of claim 1, wherein the halide component comprises a sodium halide, a lanthanum halide, a thallium halide, and a calcium halide.

10. The lamp of claim 9, wherein the lanthanum halide is present in the halide component at a mol. fraction of at least 0.009.

11. The lamp of claim 9, wherein the lanthanum halide is present in the halide component at a mol. fraction of up to 0.3.

12. The lamp of claim 9, wherein the sodium halide is present in the halide component at a mol fraction of at least 0.3.

13. The lamp of claim 9, wherein the thallium halide is present in the halide component at a mol fraction of at least 0.01.

14. The lamp of claim 9, wherein the calcium halide is present in the halide component at a mol fraction of at least 0.09.

15. The lamp of claim 9, wherein the available oxygen is at a concentration of at least 0.14 μmol O/cc.

16. The lamp of claim 15, wherein the available oxygen is at a concentration of at least 0.3 μmol O/cc.

17. The lamp of claim 15, wherein the available oxygen is at a concentration of up to 1.5 μmol O/cc.

18. The lamp of claim 17, wherein the available oxygen is at a concentration of up to 1.0 μmol O/cc.

19. The lamp of claim 15, wherein the lanthanum halide is present in the halide component at a mol. fraction of at least 0.009.

20. The lamp of claim 15, wherein the lanthanum halide is present in the halide component at a mol. fraction of up to 0.3.

21. The lamp of claim 15, wherein the sodium halide is present in the halide component at a mol fraction of at least 0.3.

22. The lamp of claim 15, wherein the thallium halide is present in the halide component at a mol fraction of at least 0.01.

23. The lamp of claim 15, wherein the calcium halide is present in the halide component at a mol fraction of at least 0.09.

24. The lamp of claim 9, wherein the available oxygen is at a concentration that provides a lumen maintenance at 1000 hrs, expressed as a percentage of lumens at 100 hrs, of at least 98%.

25. The lamp of claim 24, wherein the available oxygen is at a concentration that provides a lumen maintenance at 1000 hrs, expressed as a percentage of lumens at 100 hrs, of at least 99%.

26. The lamp of claim 1, wherein the halide component is free of all rare earth halides other than halides of lanthanum, cerium, neodymium, praseodymium, and samarium.

27. The lamp of claim 26, wherein the fill is free of all rare earth halides other than halides of lanthanum.

28. The lamp of claim 27, wherein the available oxygen is at a concentration of at least 0.14 μmol O/cc.

29. The lamp of claim 28, wherein the available oxygen is at a concentration of at least 0.3 μmol O/cc.

30. The lamp of claim 27, wherein the available oxygen is at a concentration of up to 1.5 μmol O/cc.

31. The lamp of claim 30, wherein the available oxygen is at a concentration of up to 1.0 μmol O/cc.

32. The lamp of claim 27, wherein the available oxygen is at a concentration that provides a lumen maintenance at 1000 hrs, expressed as a percentage of lumens at 100 hrs, of at least 98%.

33. The lamp of claim 27, wherein the available oxygen is at a concentration that provides a lumen maintenance at 1000 hrs, expressed as a percentage of lumens at 100 hrs, of at least 99%.

34. The lamp of claim 27, wherein the lanthanum halide is present in the halide component at a mol. fraction of at least 0.009.

35. The lamp of claim 27, wherein the lanthanum halide is present in the halide component at a mol. fraction of up to 0.3.

36. The lamp of claim 1, wherein the lamp further satisfies a lumen maintenance of at least 95% at 2000 hours.

37. The lamp of claim 1, wherein the ionizable fill further includes mercury.

38. The lamp of claim 1, wherein the available oxygen is provided by a source of available oxygen disposed in the discharge vessel.

39. The lamp of claim 38, wherein the source of available oxygen comprises an oxide of tungsten.

40. The lamp of claim 1, wherein a ratio of $$\frac{[\text{total halide}]}{[\text{O}]} \Big/ \text{cc}$$

of arc tube volume in the fill is from 900 to 6000.

41. The lamp of claim 40, wherein the molar ratio of $$\frac{[\text{total halide}]}{[\text{O}]} \Big/ \text{cc}$$

of arc tube volume in the fill is from 1000 to 5700.

42. A method of operating a lamp comprising:

providing the lamp of claim 1;

operating the lamp by supplying an electric current to the lamp to generate a discharge in the lamp vessel, wherein in operation, the lamp operates at a 1000 hr % lumen maintenance of at least 98.

43. A lamp comprising:

a discharge vessel;

electrodes extending into the discharge vessel;

an ionizable fill sealed within the vessel, the fill comprising:

a buffer gas, and a halide component, the halide component consisting essentially of halides which, to the extent that they form oxides during lamp operation, the oxides formed are unstable oxides which provide available oxygen; and available oxygen, sealed within the discharge vessel, at a concentration of 0.1-1.5 μmol O/cc.

44. A method of forming lamps with a high lumen maintenance comprising:

providing a set of ceramic metal halide lamps with a halide fill component and a source of available oxygen, whereby at least three lamps of the set differ in their respective available oxygen concentrations to provide lamps covering a range of different available oxygen concentrations within a range of from 0.1 μmol O/cc-1.5 μmol O/cc;

operating each of the lamps by supplying an electric current to the lamp to generate a discharge in the lamp vessel;

determining a lumen maintenance value for each of the lamps; and computing an optimum oxygen concentration or concentration range based on the determined lumen maintenance values;

forming lamps with the computed oxygen concentration or within the computed concentration range.

45. The lamp of claim 43, wherein the ionizable fill further comprises mercury.

* * * * *